United States Patent [19]

Schukolinski

[11] 4,359,847

[45] Nov. 23, 1982

[54] WATERTIGHT EXPANSION JOINT

[75] Inventor: Manfred Schukolinski, Velbert, Fed. Rep. of Germany

[73] Assignee: MIGUA-Hammerschmidt GmbH & Co., Velbert, Fed. Rep. of Germany

[21] Appl. No.: 265,349

[22] Filed: May 19, 1981

[30] Foreign Application Priority Data

May 24, 1980 [DE] Fed. Rep. of Germany ..... 3020035

[51] Int. Cl.[3] ..... E04F 15/14; E04B 1/62; E04B 1/68

[52] U.S. Cl. ..... 52/396; 52/466; 52/573; 404/68

[58] Field of Search ..... 404/68, 69, 64, 65, 404/49; 49/475; 52/396, 276, 277, 278, 461, 466, 467, 573

[56] References Cited

U.S. PATENT DOCUMENTS

| | | | |
|---|---|---|---|
| 3,344,720 | 10/1967 | Hallock | 52/396 |
| 3,372,521 | 3/1968 | Thom | 52/573 |
| 3,390,501 | 7/1968 | Driggers | 52/278 |
| 3,394,639 | 7/1968 | Viehmann | 404/47 |
| 3,417,528 | 12/1968 | Hallock | 52/396 |
| 3,750,359 | 8/1973 | Balzer et al. | 52/396 |
| 4,063,839 | 12/1977 | Brown | 52/396 |
| 4,140,419 | 2/1979 | Puccio | 52/396 |

*Primary Examiner*—Price C. Faw, Jr.
*Assistant Examiner*—Michael Safavi
*Attorney, Agent, or Firm*—Arthur B. Colvin

[57] ABSTRACT

A watertight expansion joint sealing section for the gap between two adjacent floor surfaces comprising an elastic bridging strip member having its two longitudinal edges secured to a rigid elongated intermediate member which in turn is secured to the vertical leg of an associated bracket which has a horizontal leg secured to the floor structure on each side of the gap. A cover strip is positioned over each of the longitudinal edges of the bridging strip and compressed there-against to form a watertight seal.

5 Claims, 1 Drawing Figure

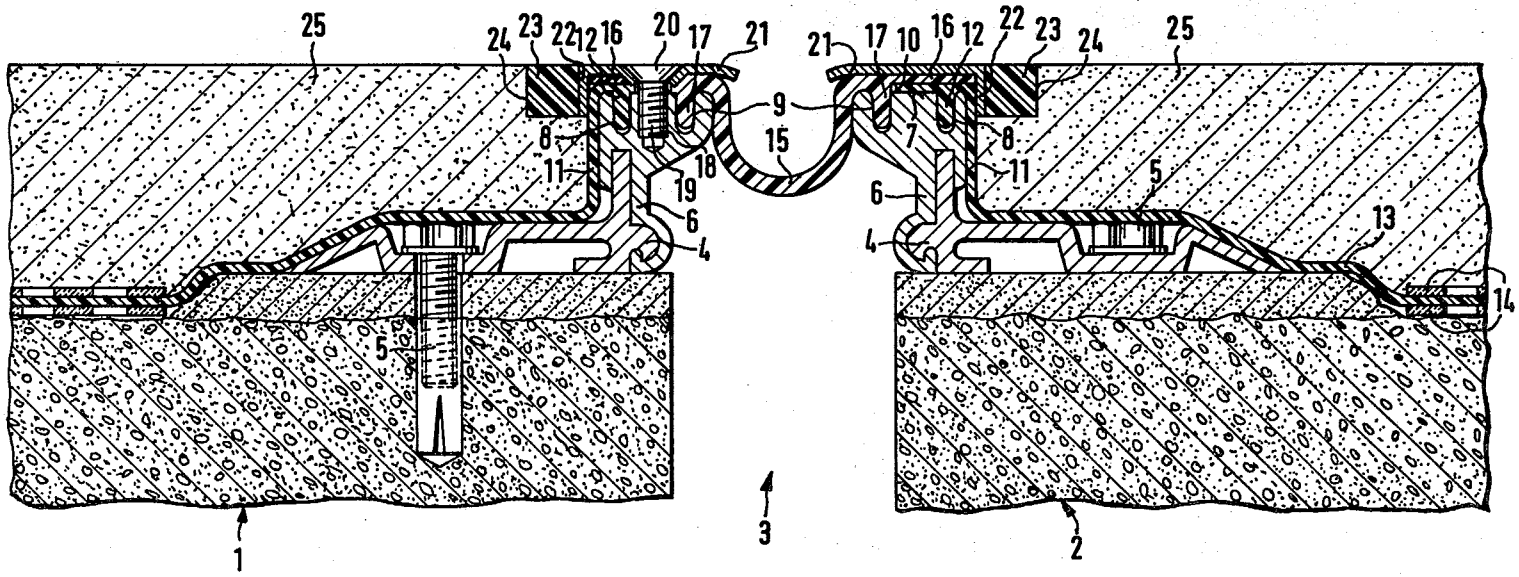
25
24
23
22
12
16
17
10
21
21
17
20
16
12
22
23
24
25
14
13
5
8
11
7
6
4
9
15
18
19
6
4
8
11
5
2
3
1

WATERTIGHT EXPANSION JOINT

The invention relates to a new watertight expansion joint sealing section for the gap between adjacent floor surfaces of a structure, consisting of an elastic bridging strip member which is held at each of its two longitudinal edges by an associated rigid intermediate member mounted on one leg of an L-shaped anchoring bracket, said leg extending perpendicular to the floor, the other leg extending essentially parallel to the associated floor surface and being anchored thereto, to be separated from each other by the expansion joint.

Known sealing sections of this kind are used for example in floor areas of parking garages and must be absolutely watertight to avoid damage to the structure.

The possibility of making the elastic bridging member at the factory in lengths corresponding to the structure dimensions, which is already very expensive, does not lead to a watertight construction of the floor surfaces. Depending on the subdivision of the floor area of a building, tilting occurs, e.g., in the walkway area, while grooves meeting at right angles or crossing require expensive T- or cross-shaped pieces which, although they can be connected with the bridging member by vulcanization, do not result in watertightness.

With the known expansion joint sealing sections, watertightness can be achieved only if the elements of the sections which mainly are generally made of steel are properly welded on the site by specialists. This very costly measure may be justified in proportion to the total cost of the construction at highly stressed bridge joints. But for expansion joints in the floor of a building this expense is not acceptable.

It is the object of the invention to provide a watertight expansion sealing section which can readily be installed on the site, to be carried out exclusively by specially trained personnel. The sealing section, according to the invention, can be installed at minimum cost of time and labor, on the site, regardless of weather conditions. In addition, the sealing section can be preassembled at the factory, thereby simplifying the handling at the site. Lastly, the sealing section insures watertight closure of the expansion joints over the entire floor area of a structure.

According to the invention each longitudinal edge of the elastic bridging member overlaps with a longitudinal edge of an elastic cover strip disposed parallel to the length of the joint to be sealed, and the two overlapping longitudinal edges are pressed together in watertight relation by a strip engaging over the overlap region and secured to the respective intermediate section.

Due to the overlap of each of the longitudinal edges of the elastic bridging member with the longitudinal edges of a cover strip, a watertight connection of the metal members of the sealing joint can be dispensed with, as the bridging member with the cover strips forms a continuous barrier against water over all section parts. The cover strips, likewise preferably made of chemical materials like the bridging member, can be welded together at the joints in known manner without any specialized knowledge or skills.

According to a feature of the invention, the longitudinal edges of the bridging member overlap longitudinal edges of the cover strips, each intermediate section having under the overlap region of the longitudinal edges a bearing surface oriented parallel to the floor of the structure, which bearing surface has two grooves extending along the length of the intermediate section, one of which receives a web or fin extending away from the bridging member outside the overlap region, while the other receives a web or fin extending away from the cover strip within the overlap region.

The design, according to the invention, has the advantage that after the attachment of the anchoring brackets with the intermediate sections mounted thereon along their length, the cover strips with the respective webs or fins can already be fixed in the corresponding groove of the intermediate section, so that the unfinished floor of the structure can be given its final covering forming the floor area before the bridging member is installed. In the meantime it may be advisable to close the joint or gap with an auxiliary section, which, for example, can be fixed with corresponding webs or fins into the still free grooves of the intermediate sections, so that during the execution of the final work on the floor, the joint or gap and the grooves in the intermediate sections remain clean for receiving the webs or fins of the bridging member.

According to another feature of the invention, the pressing together of the overlapping longitudinal edges of the bridging member and of the cover strips is preferably effected by providing threaded bores in the intermediate section, at intervals along its length between the grooves, into which threaded bolts passing through the longitudinal edges in the overlap region can be screwed, said bolts being fitted by a countersinkable head in corresponding bores of the locking ledges or strips.

By this inventive design, the locking strips, preferably made of steel, can after the installation of the bridging member, easily be secured to the intermediate sections, thereby the overlapping longitudinal edges undergo a corresponding compression which, due to the elasticity of the bridging member and of the cover strips, leads to an absolute sealing against water. The screw attachment of the locking strips has moreover the advantage that a defective bridging member can easily be replaced by a spare at any time.

According to a further feature of the invention, each locking strip is provided with an edge strip angularly bent downwardly toward the floor of the structure, said edge strip being spaced from a side surface of the intermediate section away from the joint according to the thickness of the cover strip which can likewise be angularly bent, a hardenable or permanently elastic material being moldable with a layer which forms the surface of the floor.

As a result of the design of the edge strips, which are not connected directly in watertight manner to a covering, they can be indirectly embedded watertight into the surface of the floor.

Lastly, a feature of the invention further provides that the effective width of each cover strip extends in a Z-shaped state over and beyond the length of the anchoring bracket parallel to the floor, and the longitudinal edge of the cover strip opposite the overlap region can be joined watertight with insulating material covering the unfinished floor.

By this design the entire unfinished floor area of a structure including the expansion joint interspaces, can receive a continuous, absolutely watertight covering, so that no water can penetrate into the unfinished structure parts either through joint interspaces or through defective places of the floor covering, and consequently building defects resulting from such leaks can be eliminated with the expansion joint sealing section according to the invention.

An embodiment of an expansion joint sealing section, according to the invention, is shown in the drawing in a transverse section.

Structure parts 1 and 2 form the unfinished floor of a structure and are separated from each other by an expansion joint 3.

On the structure parts 1 and 2, along the length of the expansion joint 3, substantially L-shaped anchoring brackets 4 in mirror symmetry are secured by screws 5 spaced at intervals along the length of the horizontal leg of the bracket. A layer of mortar disposed between the horizontal leg of the anchoring brackets 4 and the structure parts 1, 2 serve to compensate any tolerance differences of the unfinished structure before accurate installation of the anchoring brackets 4.

The vertical legs of the anchoring brackets 4, along their length have secured thereto, intermediate sections 6 which, depending on the the height and composition of the floor made of concrete, poured asphalt or slabs, may have different heights, it being possible, due to the snap fit of section 6 to the vertical leg to interchange the intermediate sections according to the required height, since the joining is effected by simple pushing on in lengthwise direction of the section. The interchangeability of the intermediate sections 6 permits also the compensation of different levels of two structure parts without requiring a different section design.

Each of the intermediate sections 6 has a bearing surface 7 oriented parallel to the floor of the structure and two grooves 8, 9 interrupting said bearing surface and extending over the length of the sections.

On bearing surface 7 lies a longitudinal edge 10 of a cover strip 11 of Z-shaped cross-section, strip 11 being retained by a web or fin 12 extending in a cone-shaped cross-section and press-fitted into groove 8. The outer edge 13 of the cover strip 11 extends beyond the anchoring bracket 4 and is glued watertight between lengths of insulating material 14 extending over the structure parts 1, 2.

An elongated bridging member 15, made of the same elastic material as the cover strips 11, has its longitudinal edges 16 overlapping the longitudinal edge 10 of each of the cover strips 11, the members 15 having a web or fin 17 of cone-shaped cross-section press fitted into the groove 9 of the respective intermediate section 6.

Between the grooves 8 and 9, spaced over the length of the intermediate section 6, threaded bores 18 are provided, wherein are screwed threaded bolts 19 passing through the longitudinal edges 10 and 16, said bolts detachably connecting, by a countersinkable head 20, ledges 21 of a steel strip with the respective intermediate section 6 while pressing together the longitudinal edges 10 and 16.

Angularly bent edge strips 22 of the ledges 21 are associated with corresponding recesses 24 of the floor-forming covering 25, said recesses being filled with an elastic material 23.

As material for the bridging member 15 and for the cover strips 11, one uses preferably a weldable plastic material of rubber-elastic properties. With it, obtuse angle, T and cross connections can be produced at low cost both at the factory and at the site. The costs connected therewith are factions of conventional vulcanization as is required for rubber sections. The intended material is outstanding for its very high ultimate elongation, good tearing strength, outstanding heat stability and excellent oil, gasoline and hexane stability. In addition, a very good aging and ozone stability as well as a good low-temperature flexibility are insured. The material is stable also to all media occurring in waste water, such as hydrogen sulfide, microbes, bacteria, etc. and it fulfils all requirements normally demanded of expansion joint sealing sections.

Having thus described my invention, what I claim as new and desire to secure by Letters Patent of the United States is:

1. A waterproof expansion joint sealing section for the gap between adjacent floor surfaces of a structure comprising an elastic bridging member having longitudinally directed edges, an anchoring bracket having a vertical leg and a horizontal leg extending essentially parallel to the floor, means securing said horizontal leg of each of said brackets to an associated floor surface on each side of the gap therebetween, an intermediate member secured to each of said vertical legs and rising therefrom, an elastic covering strip disposed parallel to the length of the gap, each of said longitudinal edges of the elastic bridging member being disposed in overlapping relation to a longitudinal edge of said covering strip, a retaining strip extending over said two overlapping longitudinal edges, means co-acting with said intermediate member to maintain said retaining strip in compression relative to said overlapping edges against said intermediate member to provide a watertight connection.

2. An expansion joint sealing section in accordance with claim 1 in which each said intermediate members has under the overlap region of said two longitudinal edges, a bearing surface oriented parallel to the floor of the structure, said bearing surface having two grooves extending along the length of the intermediate member, one of said grooves being adapted to receive a web extending from the bridging member outside the overlap region while the other groove is adapted to receive under press-fit a web extending from the cover strip within the overlap region.

3. Expansion joint sealing section, according to claim 1 in which threaded bores are provided in the intermediate section at intervals along the length thereof between said grooves into which threaded bolts passing through the two longitudinal edges in the overlap region can be screwed.

4. Expansion joint sealing section according to claim 1 in which each retaining strip is provided with a depending edge strip angularly bent downwardly toward the floor of the structure, said edge strip being spaced from the side face of an associated intermediate member away from the joint according to the thickness of the cover strip, the latter being angularly bent and positioned between the side face and the edge strip, a hardenable or permanently elastic material being moldable to a layer which forms the surface of the floor.

5. Expansion joint sealing section according to claim 1, in which the effective width of each cover strip extends in a Z-shaped configuration, over and beyond the length of the horizontal leg of the anchoring bracket parallel to the floor and the outer longitudinal edge of the cover strip is in watertight relationship with the floor structure.

* * * * *